US008366491B2

(12) United States Patent
Wu

(10) Patent No.: US 8,366,491 B2
(45) Date of Patent: Feb. 5, 2013

(54) USB PLUG CABLE ASSEMBLY

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/237,984

(22) Filed: Sep. 21, 2011

(65) Prior Publication Data

US 2012/0071033 A1 Mar. 22, 2012

(30) Foreign Application Priority Data

Sep. 21, 2010 (CN) ..... 2010 1 0288970

(51) Int. Cl.
*H01R 24/00* (2011.01)

(52) U.S. Cl. ..... 439/660

(58) Field of Classification Search ..... 439/660, 439/76.1

See application file for complete search history.

(56) References Cited

U.S. PATENT DOCUMENTS

| | | | | |
|---|---|---|---|---|
| 7,618,293 | B2 * | 11/2009 | Wu | 439/660 |
| 7,736,156 | B2 * | 6/2010 | Ko | 439/76.1 |
| 7,744,378 | B2 * | 6/2010 | Neumetzler et al. | 439/76.1 |
| 8,251,750 | B2 * | 8/2012 | Sun | 439/638 |
| 2011/0086548 | A1 * | 4/2011 | Wu | 439/607.41 |
| 2012/0063726 | A1 * | 3/2012 | Wu | 385/88 |
| 2012/0063727 | A1 * | 3/2012 | Wu | 385/88 |
| 2012/0071020 | A1 * | 3/2012 | Wu | 439/449 |

* cited by examiner

*Primary Examiner* — Phuong Dinh

(74) *Attorney, Agent, or Firm* — Wei Te Chung; Ming Chieh Chang

(57) ABSTRACT

A cable assembly includes a plurality of contacts, an insulation housing molded to fill and surround the contacts, a printed circuit board including a plurality of holes receiving soldering tin to electrically connect contacts to the printed circuit board, and a cover including a rectangular frame and a extending portion rearward extending from the rectangular frame to enclose a part of the printed circuit board exposed out of the insulation housing.

4 Claims, 11 Drawing Sheets

USB PLUG CABLE ASSEMBLY

FIELD OF THE INVENTION

The present invention generally relates to a USB plug cable assembly, and more particularly to a USB plug cable assembly with an improved shell.

DESCRIPTION OF RELATED ART

Universal Serial Bus (USB) is a serial bus standard to the PC architecture with a focus on computer telephony interface, consumer and productivity applications. The interface design of USB is standardized by the USB Implementers Forum (USB-IF), an industry standardized organization founded by computer and communication companies. And USB cables used to connect peripherals such as mouse devices, keyboards, PDAs, gametabs and joysticks, scanners, digital cameras, printers, external storage, networking components, etc. For many devices such as scanners and digital cameras, USB has become the standard connection method.

Most USB cable assemblies comprise a plurality of contacts, a housing molded to fill and surround the contacts, a cable electrically connected to the contacts, a metal shell enclosing the housing. In present cable assembly, a printed circuit board is always used to connect the cable and the contacts to reduce the EMI (Electro-Magnetic Interference). Mostly, the contacts are soldered on the printed circuit board. However, this method of connecting the contacts to the printed circuit board make the cable assembly difficult to own low profile.

Correspondingly, it is desired to have a cable assembly with improved structure to address the problems stated above.

BRIEF SUMMARY OF THE INVENTION

Accordingly, an object of the present invention is to provide a cable assembly with low profile.

In order to achieve the above-mentioned object, the cable assembly comprises a plurality of contacts, an insulation housing molded to fill and surround the contacts, a printed circuit board comprising a plurality of holes receiving soldering tin to electrically connect contacts to the printed circuit board, and a cover comprising a rectangular frame and a extending portion rearward extending from the rectangular frame to enclose a part of the printed circuit board exposed out of the insulation housing.

Other objects, advantages and novel features of the invention will become more apparent from the following detailed description of the present embodiment when taken in conjunction with the accompanying drawings.

DETAILED DESCRIPTION OF THE INVENTION

Figure 1:
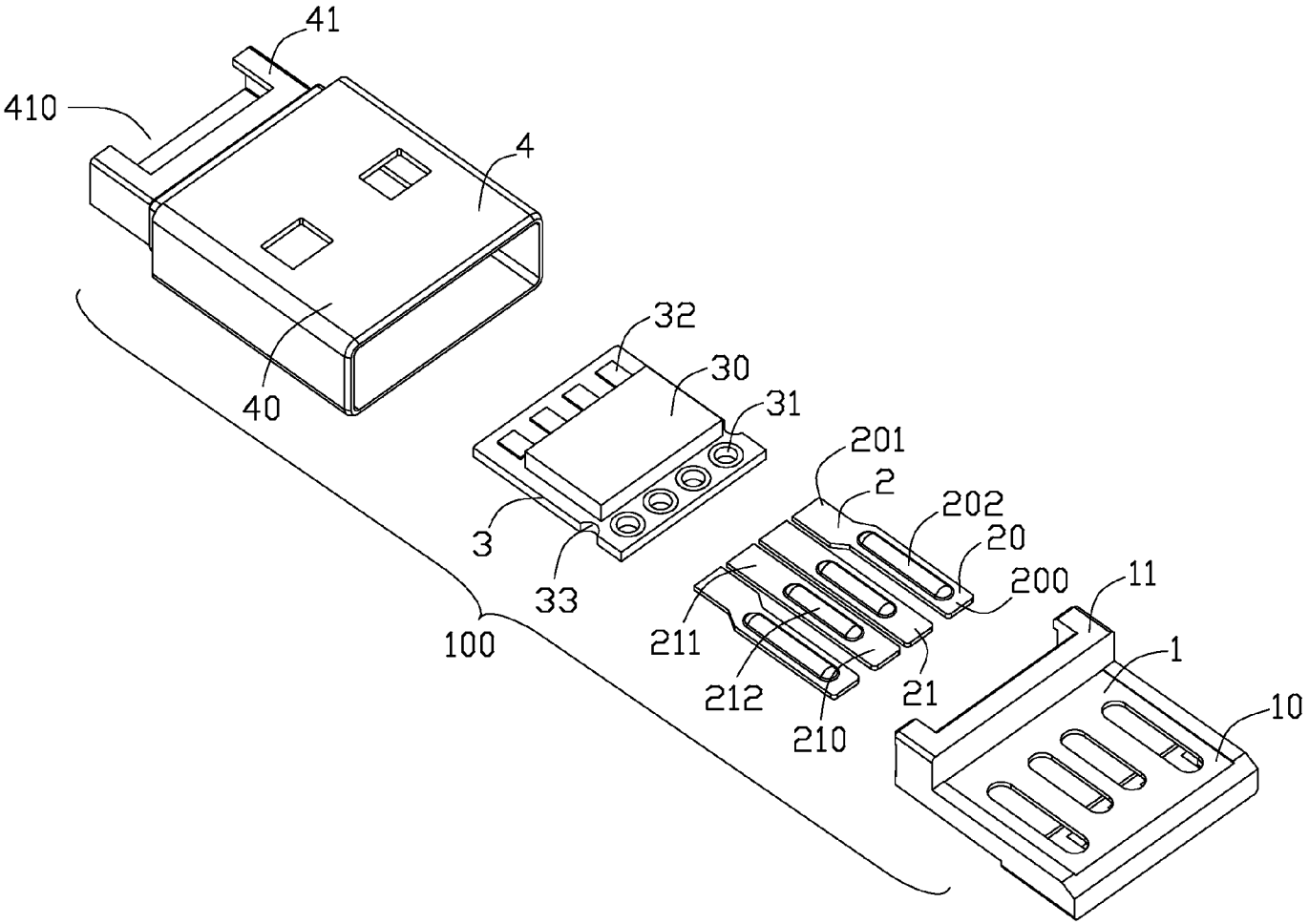
FIG. 1 is an exploded, perspective view of a cable assembly in accordance with a first embodiment of the present invention.

Reference will now be made to the drawing figures to describe the present invention in detail.

Figure 2:
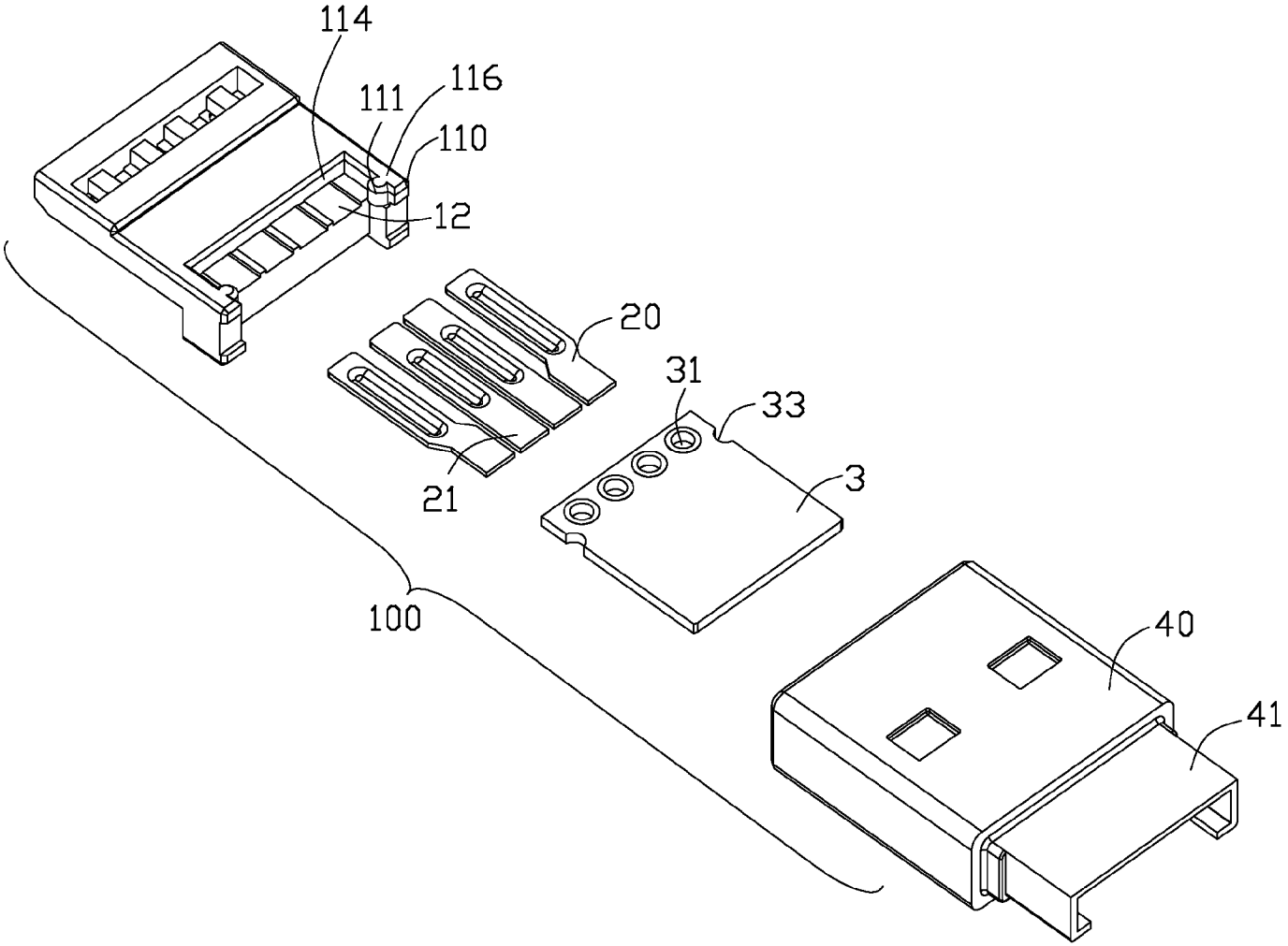
FIG. 2 is similar to FIG. 1, but viewed from another aspect.
Figure 3:
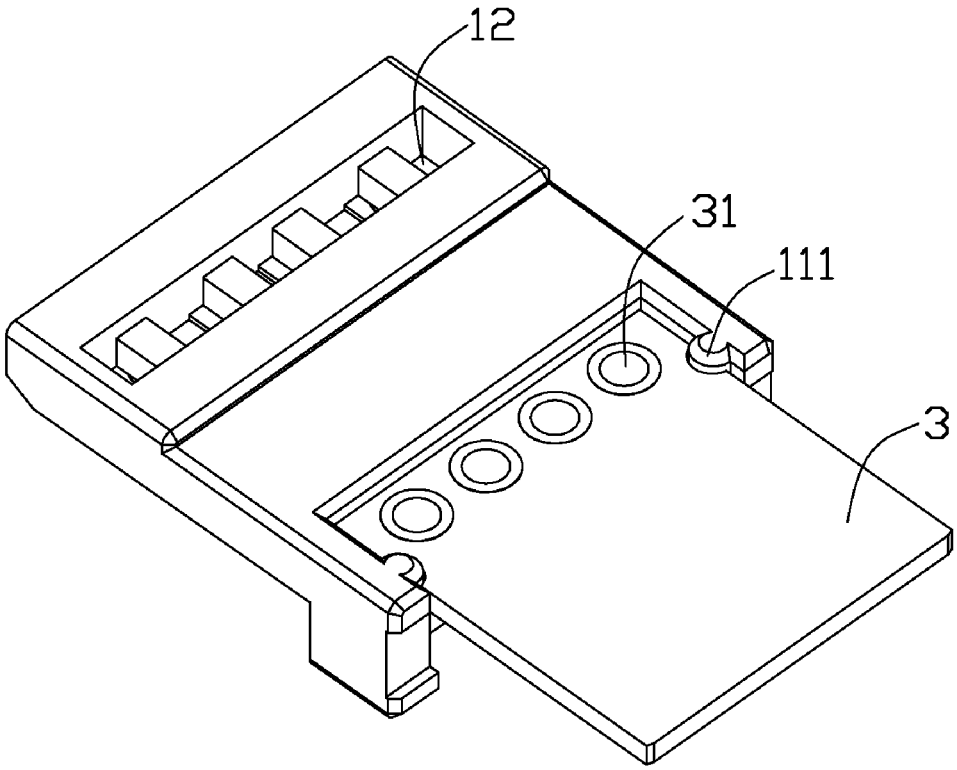
FIG. 3 is a perspective, partial assembled view of a housing, a printed circuit board and contacts of the cable assembly of FIG. 1.
Figure 4:
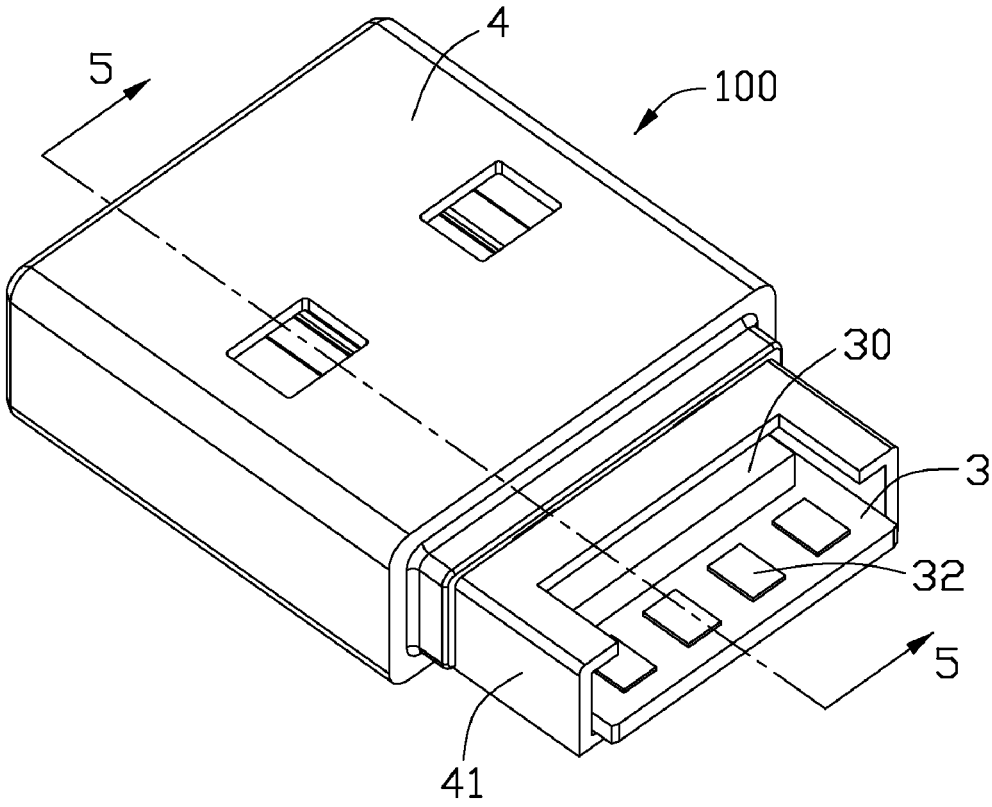
FIG. 4 is a perspective, partial assembled view of the housing, the printed circuit board, the contacts and a cover of the cable assembly of FIG. 1.
Figure 5:
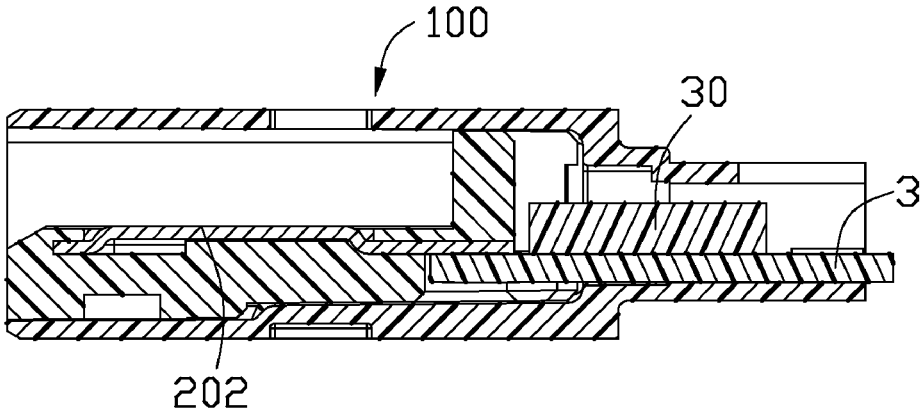
FIG. 5 is a cross-sectional view of the cable assembly taken along line 5-5 of FIG. 4.

Referring to FIGS. 1 to 5, a cable assembly 100 in accordance with a first embodiment of the present invention comprises a plurality of contacts 2, an insulation housing 1 molded to fill and surround the conducts 2, a printed circuit board 3 electrically connected to the contacts 2, and a cover 4 assembled on insulation housing 1.

The insulation housing 1 is substantially of rectangular shape and comprises a base portion or a mating tongue 10, a fastening portion 11 rearward extending from the rear surface of the base portion 10, and a plurality of receiving grooves 12 for receiving contacts 2. The fastening portion 11 has a L-shaped slot 114 which has a part extending into the base portion and connected to the lower surface of the base portion to form a pair of side wall 116 with the slot therebetween. Two pairs of protrusion 110 respevtively rearward extend from upper side and lower side of the rear surface of two side walls of the fastening portion 11. Each pair of the protrusion 110 forms a slot therebetween. A pair of fixing heave 111 respectively inward extends inner surface of the two side walls and is connected to the lower protrusion 110. The lower surface of the fixing heave 111 and the lower surface of the side walls 114 are arranged in the same plane.

In this embodiment, the cable assembly 100 comprises four contacts 2 which includes a pair of first contacts 20 located on two sides thereof and a pair of second contacts 21 located between the two first contacts 20. The first contact 20 comprises a connecting portion 200 and a tail 201 rearward extending from the rear end of the connecting portion 200. The second contact 21 comprises a connecting portion 210 and a tail 211 extending from the rear end o the connecting portion 210. Each connecting portion 200, 210 has a rim 202, 212 upward protrude from the upper surface of the connecting portion 200, 210. The tails 201, 211 of the first contacts 20 and second contacts 21 are arranged on a row.

The printed circuit board 3 is fastened between the side walls 114 of the fastening portion 11. The printed circuit board 3 comprises a plurality of electric elements 30 such as capacitances, a row of round holes 31 located in front of the electric elements 30 and communicating the upper surface with the lower surface thereof, a pair of gaps 33 formed on the two sides thereof and corresponding to the fixing heaves 111, and a row of golden fingers 32 located behind the electric elements 30 on the upper surface thereof.

The cover 4 comprises a rectangular frame 40 and extending portion 41 rearward extending from the rectangular frame 40 to enclose a part of the printed circuit board 3 exposed out of the insulation housing 1. The extending portion 41 has a cutout 410 above the golden fingers 32 of the printed circuit board 3.

Figure 6:
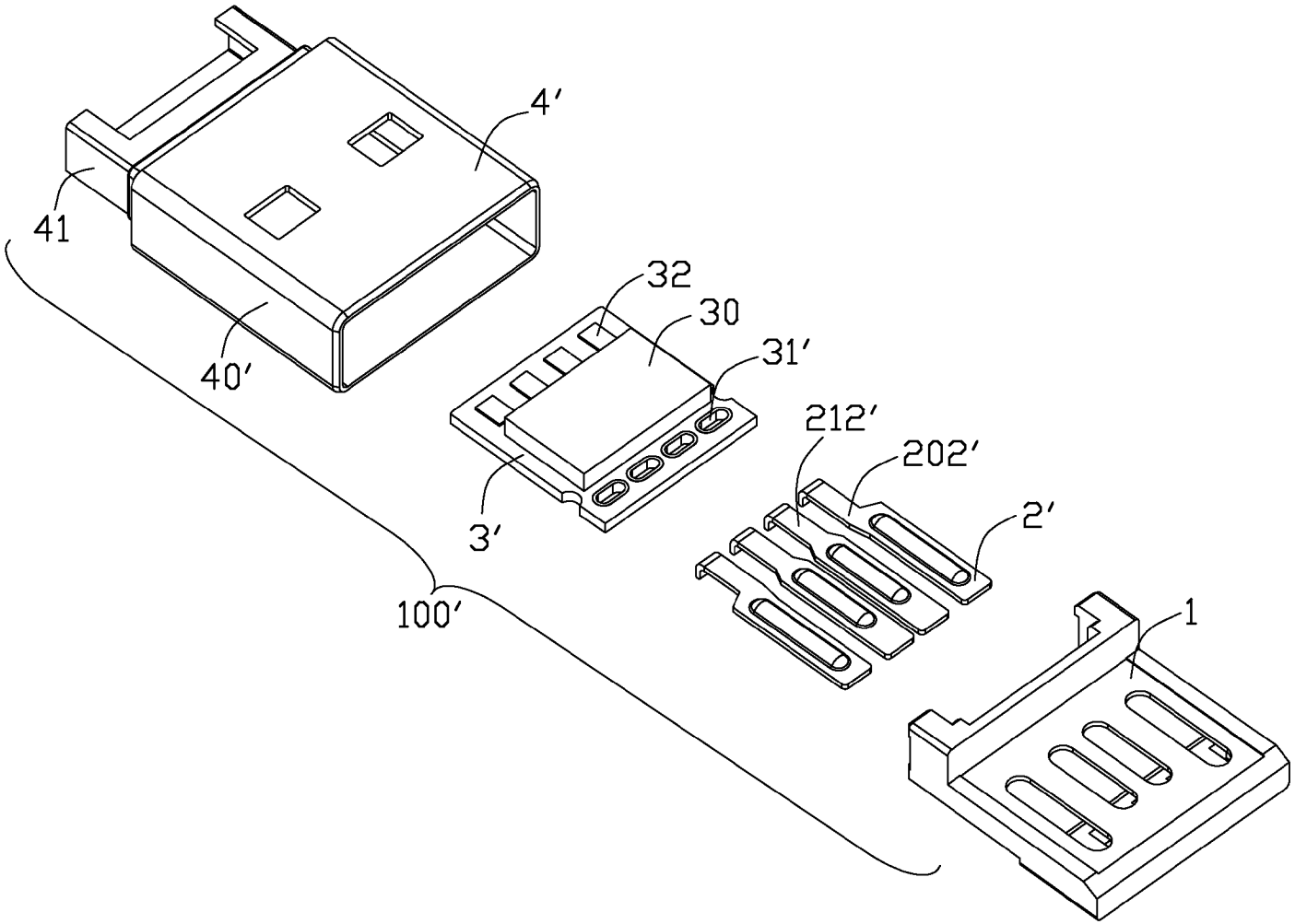
FIG. 6 is an exploded, perspective view of a cable assembly in accordance with a second embodiment of the present invention.
Figure 7:
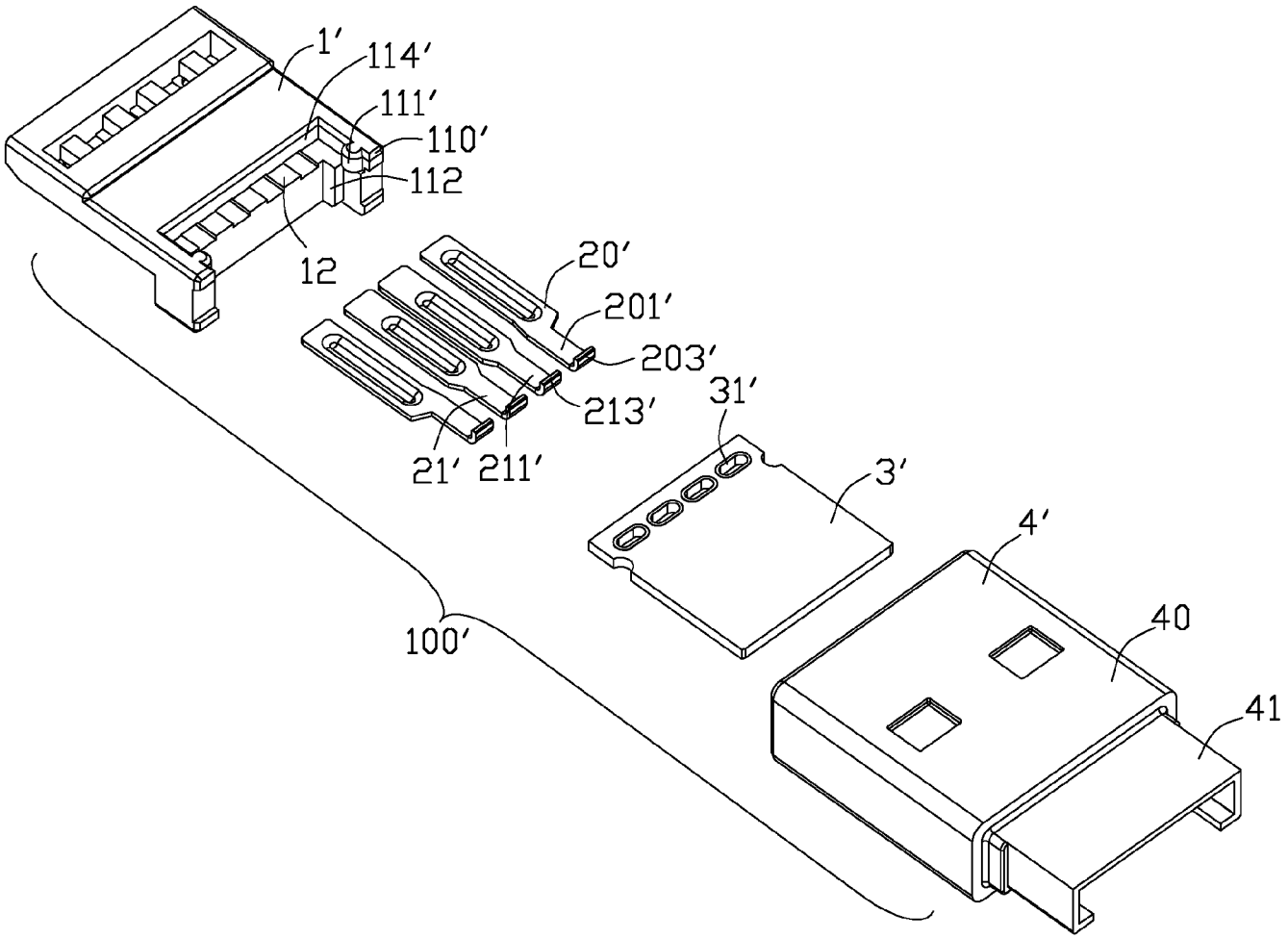
FIG. 7 is similar to FIG. 6, but viewed from another aspect.
Figure 8:
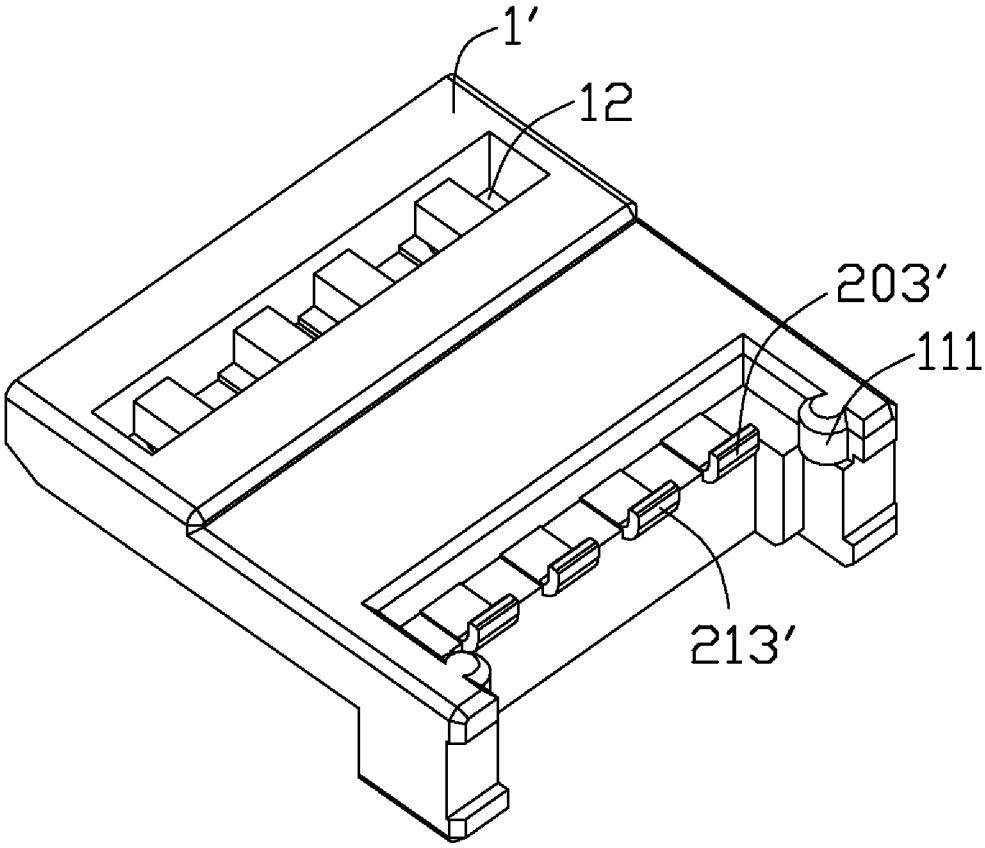
FIG. 8 is a perspective, partial assembled view of a housing, and contacts of the cable assembly of FIG. 6.
Figure 9:
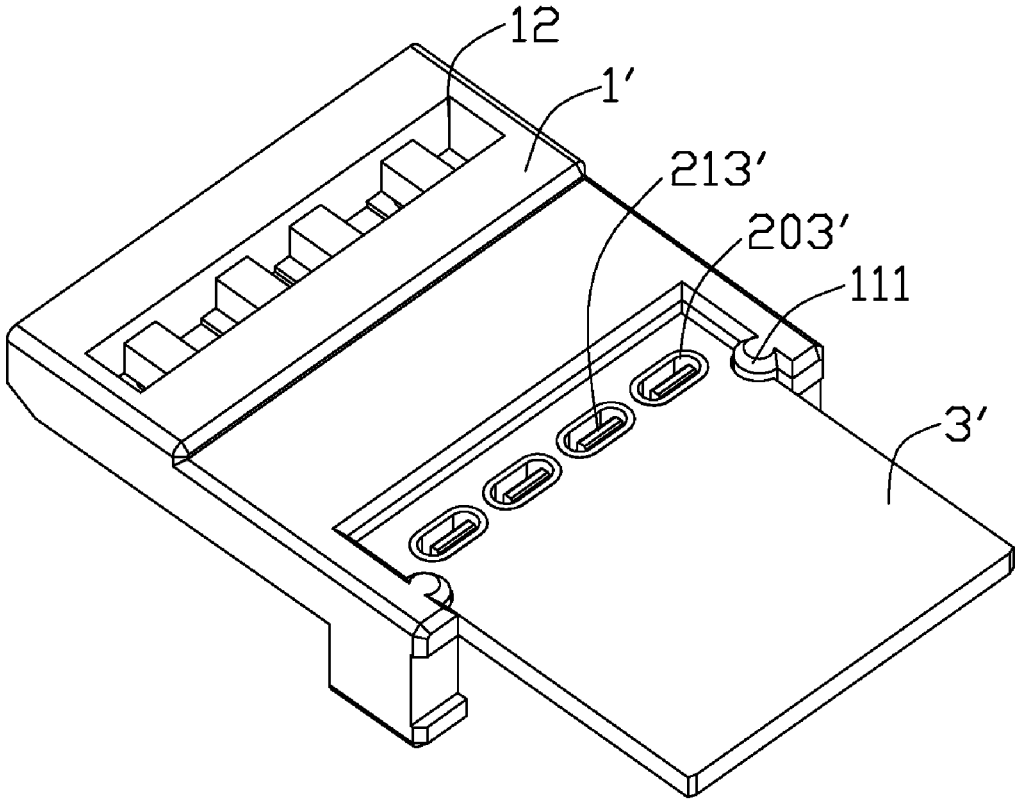
FIG. 9 is a perspective, partial assembled view of the housing, contacts and a printed circuit board of the cable assembly of FIG. 6.
Figure 10:
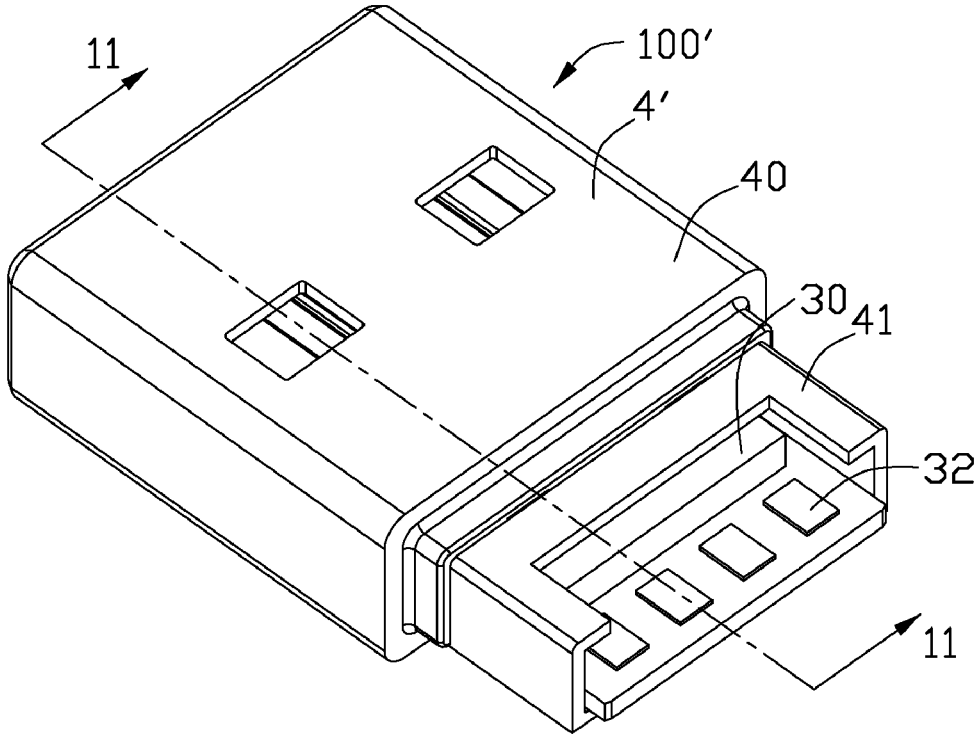
FIG. 10 is a perspective, partial assembled view of the housing, the printed circuit board, the contacts and a cover of the cable assembly of FIG. 6.
Figure 11:
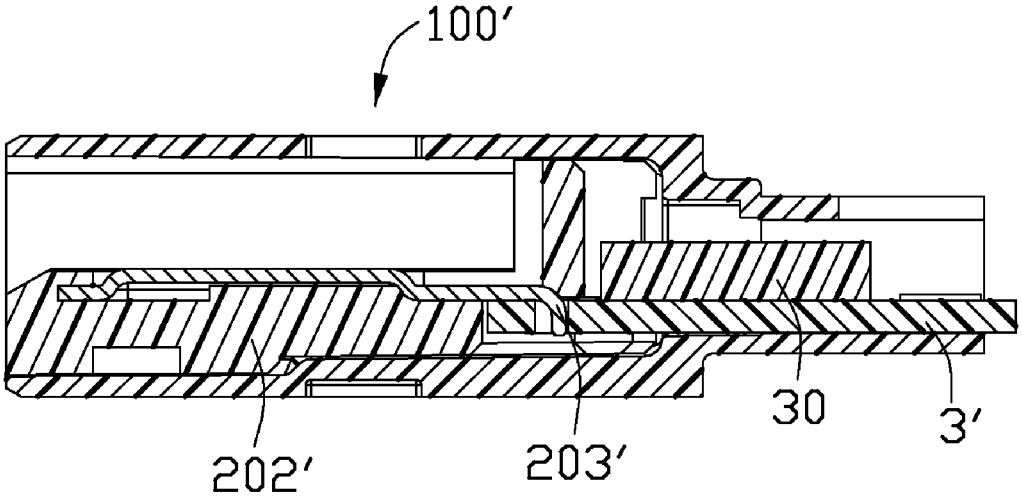
FIG. 11 is a cross-sectional view of the cable assembly taken along line 6-6 of FIG. 10.

Referring to FIGS. 6 to 11, a cable assembly 100' in according with a second embodiment of this invention is shown. The cable assembly 100' comprises a plurality of contacts 2', a insulation housing 1' molded to fill and surround the contacts 2', a printed circuit board 3' electrically connected to the contacts 2' and a cover 4' assembled on the housing 1'.

The structure of the insulation housing 1' is approximately similar to that of the insulation housing 1. The main difference between the two insulation housing 1' and 1 is that the insulation housing 1' further comprises a pair of rectangular posts 112 located on the two sides of the slot 114' and above the fixing heave 111' to be connected to the side inner surface and the rear inner surface of the slot 114'.

The structure of the contacts 2' is similar to that of the contacts 2. The main difference between the two types of contacts 2, 2' is that each tail 201', 211' further has a connecting tail 203' or 213' downward bended from the end thereof.

The structure of the printed circuit board 3' is similar to that of the printed circuit board 3'. The difference between the two printed circuit board 3, 3' is that holes 31' of the printed circuit board 3' is of elliptical shape. The structure of the cover 4' is same as the structure of the cover 4.

Reference to FIGS. 1 to 5, the cable assembly 100 of the first embodiment of this invention is assembled as below steps. Firstly, the insulation housing 1 is inserted molded to fill and surround the contacts 20, 21 with the tails 201, 211 received in the receiving grooves 12. The printed circuit board 3 is inserted into the L-shaped slot 114 with the fixing heaves 11 being respectively inserted into their corresponding gaps 33. And then the tails 201, 211 of the contacts 20, 21 are respectively soldered on their corresponding round holes 31 of the printed circuit board 3. Secondly, the cover 4 is assembled on the insulation housing 1 to enclosing the insulation housing 1 with the end of the printed circuit board 3 extending beyond the rear surface of the extending portion 41.

Reference to FIGS. 6 to 11, the assembled steps of the cable assembly 100' of the second embodiment of this invention is the same as that of the cable assembly 100. The different assembled steps between the two cable assemblies 100, 100' is the tails 201', 211' of contacts 20', 21', which own different structures form structures of the tails 201, 211 of contacts 20, 21, are respectively inserted into their corresponding elliptical holes 31' to make the contacts electrically connected to the printed circuit board 3'.

In the first, second embodiments of this invention, the cable assembly 100, 100' define a soldering method that the tails 201, 211, 201', 211' of the contacts 20, 21, 20', 21' are soldered on the printed circuit board 3, 3' by fill soldering till into the holes 31, 31' to make the contacts electrically connected to the printed circuit board 3, 3' but not traditional soldering method.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a plurality of contacts;

an insulation housing molded to fill and surround the contacts;

a printed circuit board comprising a plurality of holes receiving soldering tin to electrically connect contacts to the printed circuit board; and a cover comprising a rectangular frame and a extending portion rearward extending from the rectangular frame to enclose a part of the printed circuit board exposed out of the insulation housing, wherein said holes of the printed circuit board is of round shape, the number of the holes is the same as the number of the contacts, wherein each contact has a connecting tail downward bended from the end thereof, wherein each contact comprises a connecting portion and a tail extending from a rear end of the connecting portion, each connecting portion has a rim upward protrude from the upper surface of the connecting portion, the tails are arranged on a row, wherein said insulation housing is substantially of rectangular shape and comprises a base portion, a fastening portion rearward extending from the rear surface of the base portion, and a plurality of receiving grooves for receiving contacts, wherein said fastening portion has a L-shaped slot which has a part extending into the base portion and connected to the lower surface of the base portion to form a pair of side wall with the slot therebetween, wherein said printed circuit board further comprises a pair of gaps formed on the two sides thereof and corresponding to the fixing heaves, the printed circuit board is fastened between two side walls of the fastening portion with the fixing heaves of the fastening portion being respective inserted into their corresponding gaps.

2. The cable assembly as claimed in claim 1, wherein said holes of the printed circuit board is of elliptical shape, the number of the holes is the same as the number of the contacts.

3. A cable assembly, comprising:

a plurality of contacts;

an insulation housing molded to fill and surround the contacts;

a printed circuit board comprising a plurality of golden fingers located on a rear portion thereof and the contacts electrically connected to a front portion of the printed circuit board; and a cover comprising a rectangular frame and a extending portion rearward extending from the rectangular frame to enclose a part of the printed circuit board exposed out of the insulation housing, said extending portion having a cutout above the golden fingers of the printed circuit board, wherein said printed circuit board comprises a plurality of holes receiving soldering tin to electrically connect contacts to the printed circuit board, wherein said holes of the printed circuit board is of round shape, the number of the holes is the same as the number of the contacts, wherein said holes of the printed circuit board is of elliptical shape, the number of the holes is the same as the number of the contacts, wherein each contact has a connecting tail downward bended from the end thereof, wherein each contact comprises a connecting portion and a tail extending from a rear end of the connecting portion, each connecting portion has a rim upward protrude from the upper surface of the connecting portion, the tails are arranged on a row, wherein said insulation housing is substantially of rectangular shape and comprises a base portion, a fastening portion rearward extending from the rear surface of the base portion, and a plurality of receiving grooves for receiving contacts, wherein said fastening portion has a L-shaped slot which has a part extending into the base portion and connected to the lower surface of the base portion to form a pair of side wall with the slot therebetween, wherein said printed circuit board further comprises a pair of gaps formed on the two sides thereof and corresponding to the fixing heaves, the printed circuit board is fastened between two side walls of the fastening portion with the fixing heaves of the fastening portion being respective inserted into their corresponding gaps.

4. A cable connector assembly comprising:

an insulative housing defining a front mating tongue and a rear fastening portion thereof in a front-to-back direction;

a plurality of contacts embedded in the housing with contacting sections exposed upon the mating tongue;

a printed circuit board fastened to the fastening portion with mounting sections of the contacts mounted thereon; and a die cast metallic cover defining a front rectangular frame enclosing the mating tongue, and a rear extending portion enclosing a front portion of the printed circuit board; wherein a cross-section of the rear extending portion is smaller than that of the front rectangular frame so as to restrict assembling of the die cast metallic cover to the housing only forwardly from the fastening portion, further including means for assembling the printed circuit board to the fastening portion in a vertical direction perpendicular to said front-to- back direction, further including means for assembling the printed circuit board to the mounting sections of the contacts in a vertical direction perpendicular to said front-to-back direction.

* * * * *